US005506911A

United States Patent [19]

Neuman et al.

[11] Patent Number: 5,506,911

[45] Date of Patent: Apr. 9, 1996

[54] RADIO AND INFRARED RECEIVING COLLAPSIBLE HEARING DEVICE

[76] Inventors: Bernard Neuman; Sandra J. Neuman, both of 7972-A Lexington Club, Delray Beach, Fla. 33446

[21] Appl. No.: 259,691

[22] Filed: Jun. 13, 1994

[51] Int. Cl.[6] ..... H04R 25/00

[52] U.S. Cl. ..... 381/183; 381/187; 381/25; 381/81

[58] Field of Search ..... 381/183, 187, 381/81, 25, 68, 69, 69.2, 68.5; 379/63; 181/129, 137

[56] References Cited

U.S. PATENT DOCUMENTS

| | | | |
|---|---|---|---|
| 3,906,160 | 9/1975 | Nakamura | 179/15 BT |
| 4,465,907 | 8/1984 | Minear | 179/156 R |
| 4,633,498 | 12/1986 | Warnke et al. | 381/25 |
| 4,920,570 | 4/1990 | West | 381/68 |
| 5,177,784 | 1/1993 | Hu | 379/430 |

FOREIGN PATENT DOCUMENTS

| | | | |
|---|---|---|---|
| 2536076 | 3/1977 | Germany | 325/233 |

OTHER PUBLICATIONS

SA 500 Infrared Headset Leaflet Sound Associates 424 W 45th St. NY, NY 10036.

*Primary Examiner*—Curtis Kuntz
*Assistant Examiner*—Sinh Tran
*Attorney, Agent, or Firm*—Alvin S. Blum

[57] ABSTRACT

An assistive listening device has a housing enclosing both infrared radiation and FM radio receivers and audio amplifier for receiving audio information transmitted to the hearing impaired audience in an auditorium by either infrared or radio radiation. The received radiation is converted to an amplified electrical audio signal. The signal is converted to audible sound by two earphones at the distal ends of two extendable arms. The arms are attached at their proximal ends to the housing. The arms have two configurations, a compact configuration in which the earphones are retracted to a position against the housing for storage or transport and an extended configuration in which the earphones are at a distance from the housing and spaced apart less than the distance between a user's ears. The arms may have one or more joints for folding compactly around the edge of the housing.

8 Claims, 4 Drawing Sheets

FM
IR
V
T
100
101
102
103
104
105
106
107
108
109
110
111
112
113
114
115
116
117
118
119
120
121
122
123
124
125
126
127
128
129
130
131
132
133
140
141
9
10

RADIO AND INFRARED RECEIVING COLLAPSIBLE HEARING DEVICE

BACKGROUND OF THE INVENTION

1. Field of the Invention

This invention relates to assistire listening devices and more particularly to those devices receiving infrared and radio transmission, used by hearing impaired people while attending concerts, plays and other entertainment or educational affairs in an enclosed environment such as a theater, auditorium or other assembly room where acoustical aid is needed.

One class of equipment for overcoming hearing problems comprises a receiver housing supported by the head of a user and a pair of earphones supported adjacent to the ears of the user. The housing contains a receiver, such as an FM radio or infrared sensor or the like, which responds to audio signals on a radio or infrared carrier emitted by a transmitter. This equipment also contains means to amplify the signal and convert it to audio signal energy that drives the earphones mounted on or in a user's ears. A power source such as a battery is also included in the prior art equipment.

A novelty search of the patented art relating to hearing devices, and particularly those that are capable of moving between an expanded operational configuration and a contracted configuration for storage when not in use, discovered the following U.S. Pat. Nos.:

4,409,442 issued Oct. 11, 1983 to Kamimura;
4,445,005 issued Apr. 24, 1984 to Furuhashi;
4,463,223 issued Jul. 31, 1984 to Yamanoi et al.;
4,465,907 issued Aug. 14, 1984 to Minear et al.;
4,517,418 issued May 14, 1985 to Baran et al.;
4,571,746 issued Feb. 25, 1986 to Gorike;
4,597,469 issued Jul. 1, 1986 to Nagashima;
4,609,786 issued Sep. 2, 1986 to Omoto et al.;
5,027,433 issued Jun. 25, 1991 to Nenadier et al.;
5,095,382 issued Mar. 10, 1992 to Abe;
5,099,519 issued Mar. 24, 1992 to Guan;
5,253,095 issued Oct. 12, 1993 to Menadier et al.; and
4,920,570 issued Apr. 24, 1990 to West.

Public theaters transmit wireless signals of the sound from a performance for hearing impaired audience members on either FM radio (FM) or infrared (IR) radiation carriers. Management provides assistire listening devices (ALD's) to the public for use during a performance. The ALD receives either the FM or the IR, decodes, amplifies and converts the transmitted signal into audible sound at earphones at the distal ends of two arms extending from a housing encasing the electronics and battery.

The devices are fragile and easily damaged. Many users consider them unsanitary, since the earphones fit into or onto the ears of strangers and may transmit contaminants from the hair or ears of others.

Many users would prefer to use their own ALD, especially if it were compatible with both FM and IR. If the device were less fragile and bulky and the earphones were not exposed to soiling or damage, the ALD would be more acceptable and easier to carry to performances. If the battery did not require frequent replacement, it would be easier for incapacitated users to maintain.

Since the earphones will be in the ears while the housing is below the chin, the minimum length of the extension arms from earphones to housing is predetermined by normal human anatomy when in the operational mode.

None of the patents found in the novelty search discloses a collapsible integral hearing device for both IR and FM comprising a base housing supported by earphones, constructed and arranged to have dimensions sufficiently small to fit inside a case on the order of magnitude of an eyeglass case and also provided with a pair of jointed extension arms each constructed and arranged with a pivot pivotally connecting a distal portion of said extension arm to its proximal portion. The structural elements of the prior art devices shown in the enumerated patents are not capable of folding inward from an unfolded configuration when in use to a closed configuration in which the portions of the extension arms embrace the base housing in such a closely hugging relation that the device when closed is capable of fitting within a storage case whose size approximates that of an eyeglass case.

SUMMARY OF THE INVENTION

It is accordingly an object of the invention to provide different structural features and arrangement from those of the prior art devices. These novel structural features are particularly useful when the hearing device contains a base housing smaller than those required for the relatively large circuit elements of the prior art that have been replaced with miniaturized circuit elements that form part of the improved state of the art.

Beause of the novel construction of the collapsible hearing device of this invention, it is possible for a theater to store many cases containing hearing devices in a storage space considerably smaller than was required for the large hearing devices of the prior art. Also, for those users who prefer to carry their personal hearing devices with them, it is much more convenient for them to carry their hearing device in a carrier case of a size comparable to an eyeglass case than the bulkier devices of the prior art.

In a preferred embodiment of this invention, each earpiece is fixed to a distal end of an elongated jointed extension arm and each extension arm is pivotally attached at its proximal end to a base housing by one or another of a pair of proximal pivots. Each elongated extension arm is provided with a distal pivot that converts its associated extension arm into a jointed arm having at least two arm portions, a long proximal portion and a short distal portion, hinged to one another. The extension arms are constructed and arranged in such a manner that the arm portions pivot outward into positions for use wherein the earphones are aligned with the ears of the user, and are also capable of pivoting into a closed position around the base housing for storing the closed device within a case whose size approximates that of an eyeglass case. In order to make it possible to attain this goal of storing the device within such a small storage case when not in use, it is necessary to construct and arrange the elements of the hearing device in such a manner that the jointed arms and earphones carried by the distal ends thereof enclose the base housing containing the electronic elements of the hearing device as well as a power source contained within the base housing so closely as to essentially hug or embrace the top, the upper corners and the side walls of the base housing.

This hugging feature not found in the prior art devices makes it more convenient for a user who owns a hearing device to carry it from home to an auditorium, and/or makes it more convenient for a theater or auditorium to store a plurality of such hearing devices in a relatively small area of the theater or auditorium when local statutes require theater or auditorium owners to have hearing devices available for members of the audience who require help to overcome hearing problems. In a preferred embodiment of this invention, the elongated extension arms that carry the earphones at their distal ends have distal pivots that divide the elongated arms into proximal arm portions having a length approximating the length of the base housing and distal arm portions having a length approximating those of the left and right side walls of the base housing. In addition, portions of the base housing may be recessed to receive the earpieces fixed to the distal ends of the elongated arms to protect the earpieces from damage and contamination when not in operation.

The present invention may also include automatic switch means to disconnect the power source from the device automatically whenever the device is folded to a closed configuration for storage and limits the use of the power source only to those times when the device is unfolded to its open configuration for operation. This additional feature assures that the power source does not lose its strength and operability prematurely, and battery changing is not often required by the user who may be incapacitated.

In its broadest scope, each jointed extension arm of this invention comprises a proximal arm portion and at least one distal arm portion pivoted to said proximal arm portion at at least one distal pivot spaced from a proximal pivot of said jointed extension arm where the latter extends from the base housing. The distal pivot, or pivots, and proximal pivot of a given arm are arranged to rotate in a common first direction for extension and in a common, opposite direction for folding into a compact configuration.

The aforesaid and other benefits of this invention will become apparent when the detailed descriptions are studied in conjunction with the accompanying drawings.

DETAILED DESCRIPTION OF PREFERRED EMBODIMENTS

Figure 1:
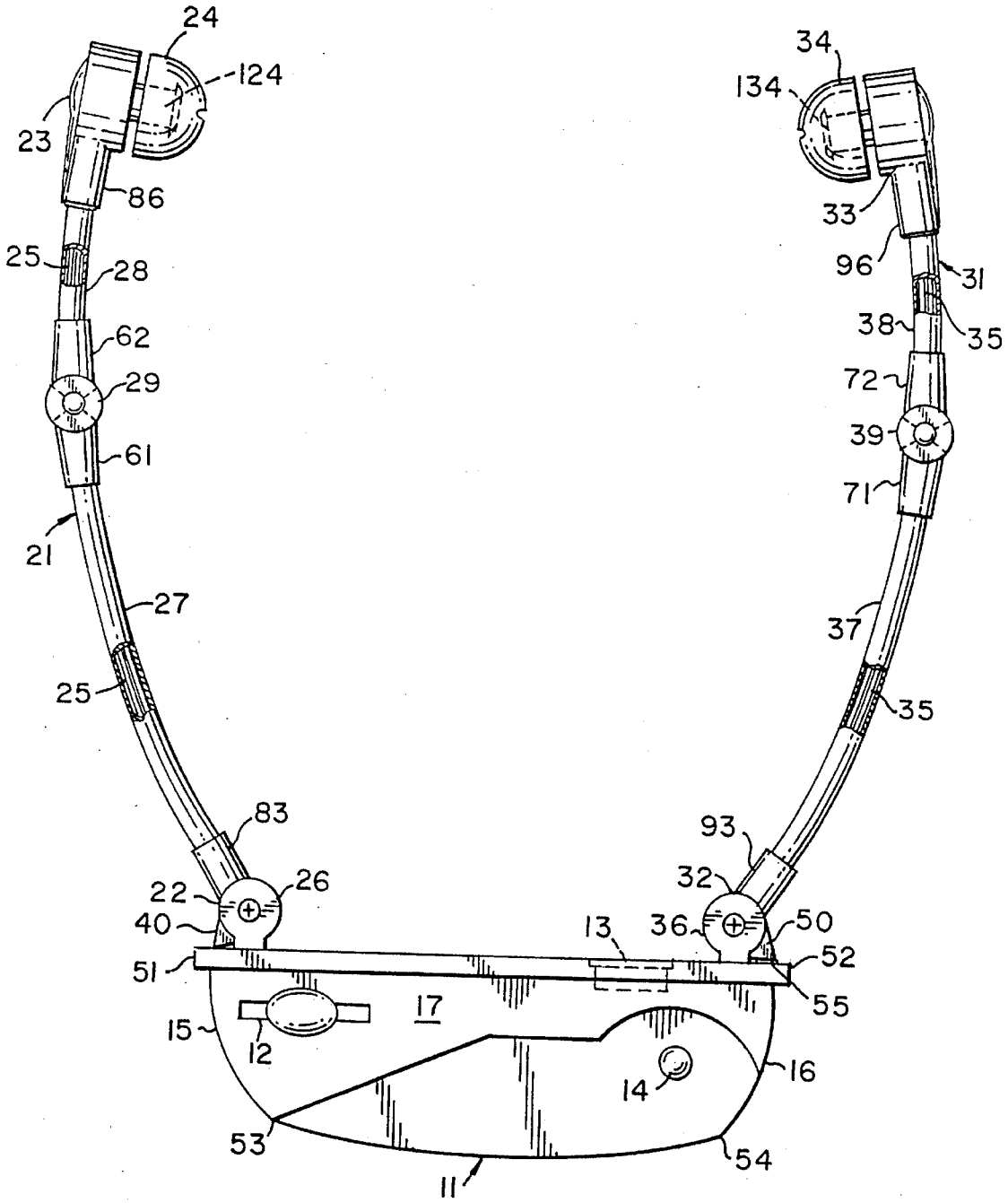
FIG. 1 is an elevational view with parts exposed of a hearing device of this invention in its open unfolded configuration ready for use.

Referring now to FIGS. 1–5, a hearing device conforming to a preferred embodiment of this invention comprises a base housing (11) constructed and arranged to support electronic decoder means (102) shown in phantom, a volume control (12), a removable and replaceable power source (13) such as a battery pack or the like, and an infrared or FM radio receiver (14), of the type well known in the art, therewithin. Base housing (11) has a top edge (410), a left side edge (15), a right side edge (16), a front wall (17) and a rear wall (18). Front wall (17) is apertured in front of a position occupied by infrared or FM radio receiver (14) so as to enable the latter to be exposed to a source of radiant energy (not shown). Housing (11) has an upper left corner portion (51), an upper right corner portion (52), a lower left corner portion (53) and a lower right corner portion (54).

The terms "left" and "right" refer to the orientation of the various elements of the illustrative device as seen by a person looking at the front side of a user. Consequently, when the device is worn by a user, each element of the device shown on the left side of the device in the drawing is carried to the right side of the user, and each element shown on the right side of the device in the drawing is carried to the left side of the user.

A left, jointed earphone extension arm (21) having a proximal end (22) and a distal end (23) is longitudinally apertured along its length to receive a pair of electroconductive wires (25), and is pivoted to the upper left corner portion (51) of base housing (11) at a proximal pivot (26). Extension arm (21) has a proximal portion (27) and a distal portion (28) pivoted to portion (27) at a distal pivot (29). In addition, an earphone (24) is fixed to distal end (23) of arm (21) to extend inward from distal end (23) into the right ear of a user.

The device is also provided with a right, jointed earphone extension arm (31) having a proximal end (32) corresponding to proximal end (22) of left extension arm (21), a distal end (33) corresponding to distal end (23), and is longitudinally apertured along its length to receive electroconductive wires (35) corresponding to wires (25). Right, jointed extension arm (31) is pivoted to upper right corner portion (52) of base housing (11) at a proximal pivot (36) corresponding to proximal pivot (26). Extension arm (31) has a proximal portion (37) pivoted to a distal portion (38) at a distal pivot (39). In addition, an earphone (34) extends inward toward earphone tip (24), so that both ears of a user are simultaneously engaged by earphones (24) and (34) when extension arms (21) and (31) are unfolded away from one another. Earphones (24) and (34) include earphone tips (124) and (134), shown in phantom.

Figure 2:
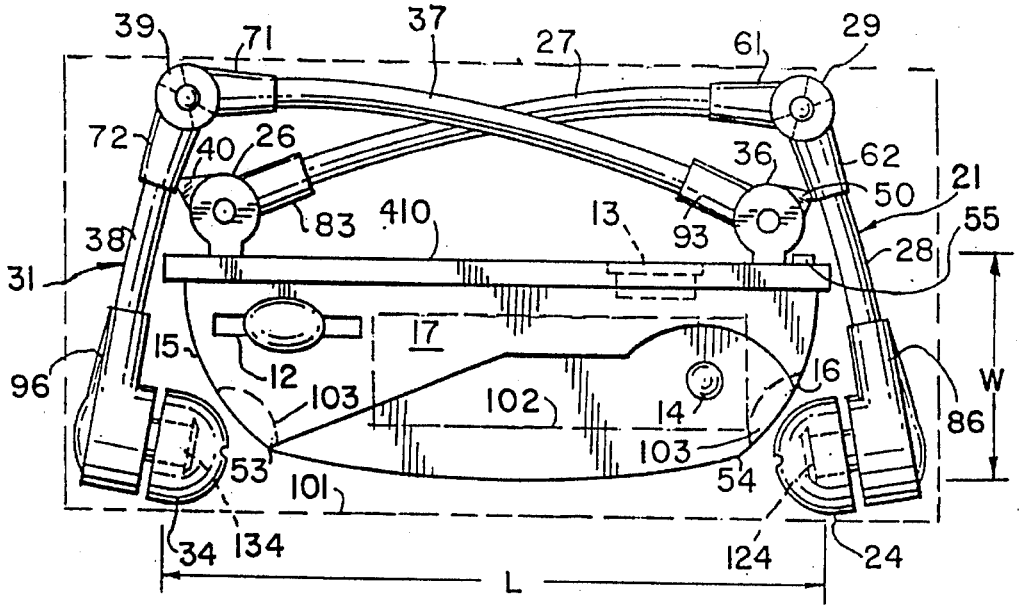
FIG. 2 is a view similar to FIG. 1, showing the FIG. 1 device folded to its closed configuration wherein the elongated arm portions that support the earphones at their distal ends are folded into a closed position wherein the device is capable of storage within a small storage case of a size approximating that required for storing a set of eyeglasses.

Jointed arm (31) is pivoted inwardly into a closed configuration around the edge of base housing (11) for storage in a small storage case whose size is on the order of magnitude of an eyeglass case. When jointed extension arm (31) is folded inward, its proximal portion (37) extends along the length (L) of base housing (11) in close relation thereto from adjacent right upper corner portion (52) to adjacent upper left corner portion (51), distal portion (38) extends along the width (W) of left side edge or wall (15) from adjacent upper left corner portion (51) to adjacent lower left corner position (53), and earphone tip (134) reaches a position closely adjacent to the left bottom corner portion (53) of base housing (11) as shown in FIG. 2.

Also, in this closed configuration, proximal portion (27) of left jointed extension arm (21) extends along the length of the top edge (410) of base housing (11) from a position adjacent upper left corner portion (51) to a position adjacent upper right corner portion (52), distal portion (28) of left jointed extension arm (21) extends downward along the right side wall or edge (16) from a position adjacent upper right corner portion (52) to a position adjacent lower right corner portion (54), and earphone tip (24) reaches a position closely adjacent the right bottom corner portion (54) of base housing (11) with portions (27) and (28) of left extension arm (21) closely adjacent to the top edge (410) and right side edge (16) of base housing (11). This folded configuration enables the device to fit into a case (101) shown in phantom while guarding the earpieces from, trauma and contamination when not in use in the ear canals.

In other words, this invention suggests that the jointed extension arms be constructed and arranged so that proximal portions (27) and (37) have lengths approximating the length of base housing (11) and the distal portions (28) and (38) have lengths approximating the length of side walls (15) and (16) of base housing (11). Thus when arms (21) and (31) are folded, they embrace base housing (11) in a substantially hugging relationship that not only insures a compact configuration for the device when not in use, but it also enables the relatively rigid structure of housing (11) to reinforce the relatively fragile structures of arms (21) and (31). If desirable, lower corner portions (53) and (54) may be recessed in outline to receive earphones (34) and (24) in the folded configuration. By positioning each fragile earphone protectively adjacent the rigid housing, the folded configurations shield the earphone against damage and contamination.

A projection (40) to be discussed later is provided in the vicinity of proximal pivot (26). Another projection (50) in the vicinity of proximal pivot (36) symmetrical to projection (40) is engaged by distal portion 28 of extension arm (21) when the latter is folded. Projection (40) and (50) are so constructed and arranged that a selected one of projections (40) or (50) turns an associated switch (55) on when arms (21) and (31) are unfolded outward and earphones (24) and (34) are applied to the ears of a user. When arms (21) and (31) are folded inward, said projection (40) or (50) turns its associated switch (55) off to enable the life of power source (13) to be extended. Projection (40) is not associated with a switch, but is included with the parts of the device to simplify the inventory of parts to assemble the device. Projections (40) and (50) limit the angle to which the extension arms may be opened so that some tension is applied to the earpieces to maintain their position in the ears.

Figure 3:
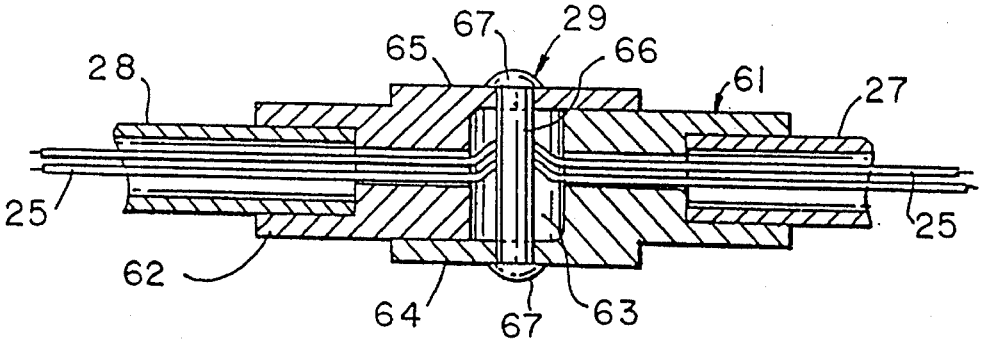
FIG. 3 is a sectional view, partially broken away, taken along line 3—3 from FIG. 4 of a portion of one of a pair of elongated extension arms taken in the vicinity of a distal pivot for said elongated extension arm.
Figure 4:
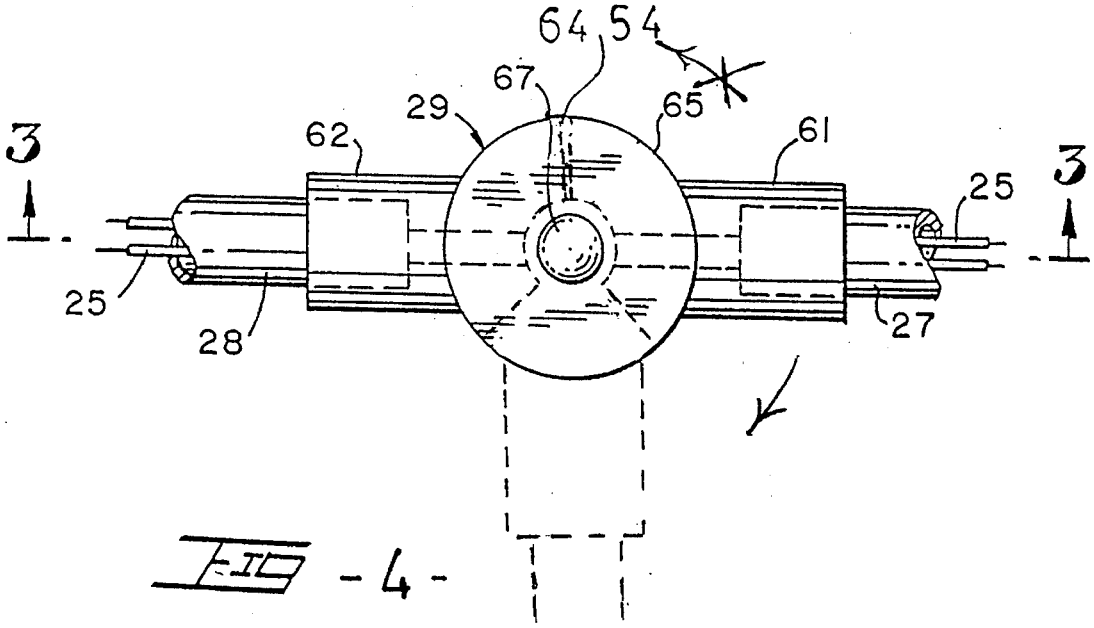
FIG. 4 is a plan view of the pivot 29.

Referring to FIGS. 3 and 4, the details of the structure of distal pivots (29) and (39) will be described. Apertured extension sleeves (61) and (62) are fit over the adjacent ends of elongated arm portions (27) and (28), respectively. A chamber (63) is formed between a radially apertured extension (64) of sleeve (61) and radially apertured extension (65) of sleeve (62). The latter extension (65) extends in the opposite direction from former extension (64). The radial aperture of radially apertured extensions (64) and (65) receive a pin (66) having enlarged heads (67) at both ends thereof. Thus, the axis of pin (66) is the axis for distal pivot (29). Chamber (63) is sufficiently large to enable portions (27) and (28) to pivot relative to one another without disturbing the portions of wires (25) that extend around pin (66) within chamber (63). When the arm is in the extended position as shown in FIG. 4, no more counterclockwise rotation is permitted because (64) and (65) abut at (6465). This overextension limiting mechanism combined with that provided by projections (40) (50) for proximal pivots provides earpiece tension.

Returning to FIG. 1, distal pivot (39) for jointed earphone extension arm (31) is arranged as a mirror image of the structures of distal pivot (29) for jointed earphone extension arm (21), with apertured extension sleeves (71) and (72) serving the same purpose for distal pivot (39) as sleeves (61) and (62) perform for distal pivot (29).

Extension sleeve (61) and reinforcement (83) strengthen the distal and proximal ends of arm portion (27), respectively. Extension sleeve (62) and reinforcement (86) do likewise for the proximal and distal ends of arm portion (28). Furthermore, extension sleeves (71) and (72) and reinforcements (93 and (96) strengthen the corresponding ends of arm portions (37) and (38) of arm (31). Such strengthening reduces the likelihood of breakage when the elongated extension arms are connected to one another and to base housing (11) during assembly and use of the device.

Figure 5:
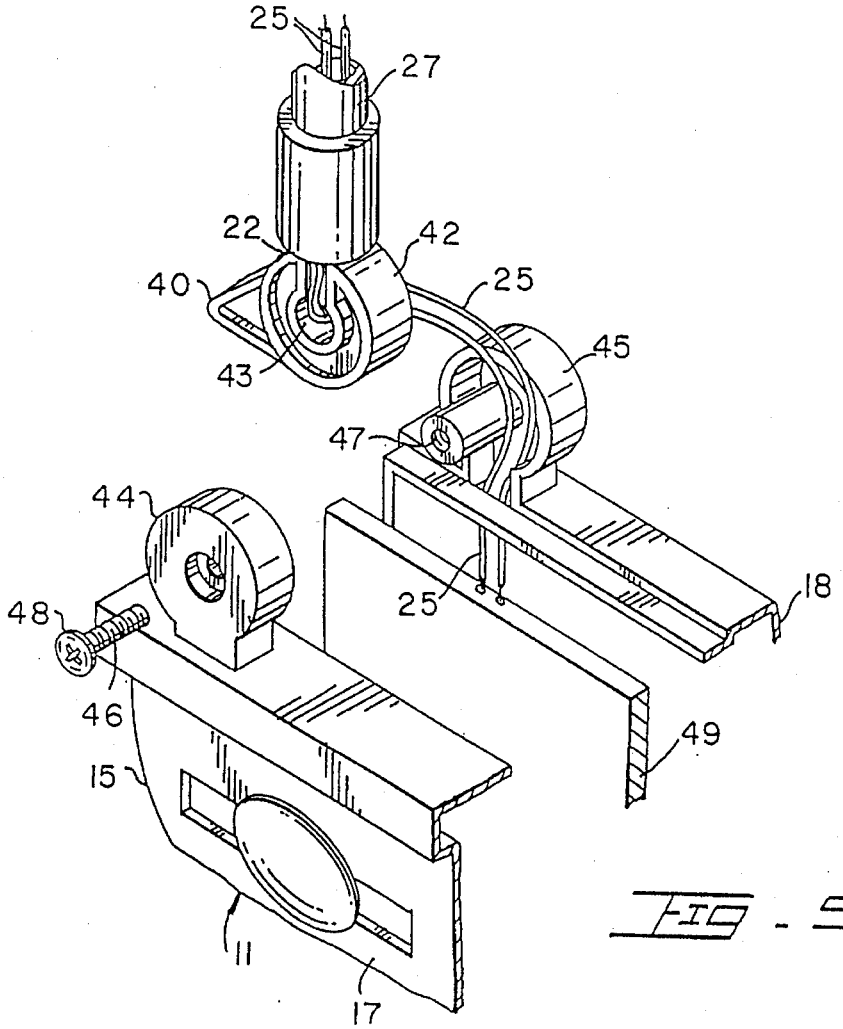
FIG. 5 is an exploded perspective view near a proximal pivot between the proximal end of one of the elongated extension arms and a base housing.

Referring to FIG. 5, the reader can understand the construction of a proximal pivot (26) between proximal end (22) of proximal portion (27) of left, jointed earphone extension arm (21) and the upper left corner portion (51) of base housing (11) from the description that follows. It is also the basis for similar mirror-image structure for pivotally connecting-proximal end (22) of proximal portion (37) of right, jointed earphone extension arm (31) to the upper right corner portion (52) of base housing (11).

Projection (40) is carried near the perimeter of an axially apertured disc housing (42) that defines an outer surface of a chamber (43). The latter is located in the proximal direction axially of proximal end (22) with the transverse dimension of housing (43) extending between a pair of aligned apertured bosses (44) and (45). The latter extend obliquely outward from the upper left-hand corner portion (51) of front wall (17) and rear wall (18) of base housing (11). An externally threaded screw (46) engages an internally threaded, transversely extending sleeve (47). Screw (46) has a slotted head (48) that facilitates engagement of screw (46) and sleeve (47).

An electronic board (49) carries infrared or FM radio sensing, amplifying and decoding means converting the sensed radiation into audio signals to the earphones. It is supported within base housing (11), and wires (25) are connected at their proximal ends to a left upper corner portion of said electronic board (49). Bosses (44) and (45) are constructed and arranged to provide chamber (43) with a circumferential configuration around sleeve (47) and between the inner surface of sleeve (47) and disc housing (42) to allow wires (25) clearance to pass from the upper left corner portion (51) of base housing (11) to left earphone extension arm (21), and around internally threaded sleeve (47) in chamber (43) without disturbing the continuity of wires (25) when proximal arm portion (27) pivots. A similar construction for pivotally connecting proximal end (32) of elongated extension arm (31) to upper corner portion (52) and wires (35) to the upper right corner portion of electronic board (49) is also included in the preferred embodiment, except that the construction provided for clearance for wires (35) is the mirror image of the construction provided for the clearance for wires (25).

Each of the movable elements of the device, such as arm portions (27) and (28) of jointed arm (21) and arm portions (37) and (38) of jointed arm (31) are mirror images of corresponding portions of one another, including their respective sleeves (61), (62), (71) and (72) and their reinforcements (83), (86), (93) and (96). This feature facilitates the manufacture of the device and allows the use of either projection (40) or projection (50) to actuate switch (55) that controls operation of power source (13), depending on the location of switch (55). In FIG. 1, projection (50) is shown engaging switch (55) to actuate power source (13) when the device is in use. In FIG. 2, projection (50) is offset from switch (55), so that power source (13) is deactivated when the device is folded inward for storage. Projection (40) may be used to actuate a switch if the latter is located in position for actuation by projection (40) rather than projection (50). Both projections (40) and (50) also limit the angle of rotation of the pivots so that extension arms, when open, apply tension to the earpieces.

Referring now to FIGS. 6–10, an ALD (100) is shown that provides for receiving both IR radiation through three IR sensors (101) facing in three different directions and FM radiation through antenna (102). An IR amplifier and decoder (105) receives infrared radiation from sensors (101), and feeds audio signals to IR/FM selector switch (103). An FM amplifier and decoder (106) receives radiation from antenna (102), and feeds audio signals to IR/FM selector switch (103). A tuning control (107) may be provided to select particular FM frequency or bandwidth response. The decoded signals selected by switch (103) from either IR or FM are then fed to audio amplifier (108) which may be provided with volume control (109). The amplified audio signals are fed by wire to the individual earphones (104) where they are transduced into audible signals. Battery (110) provides power through on/off switch (111).

Figures 6, 7, 8, 9, 10, 11:
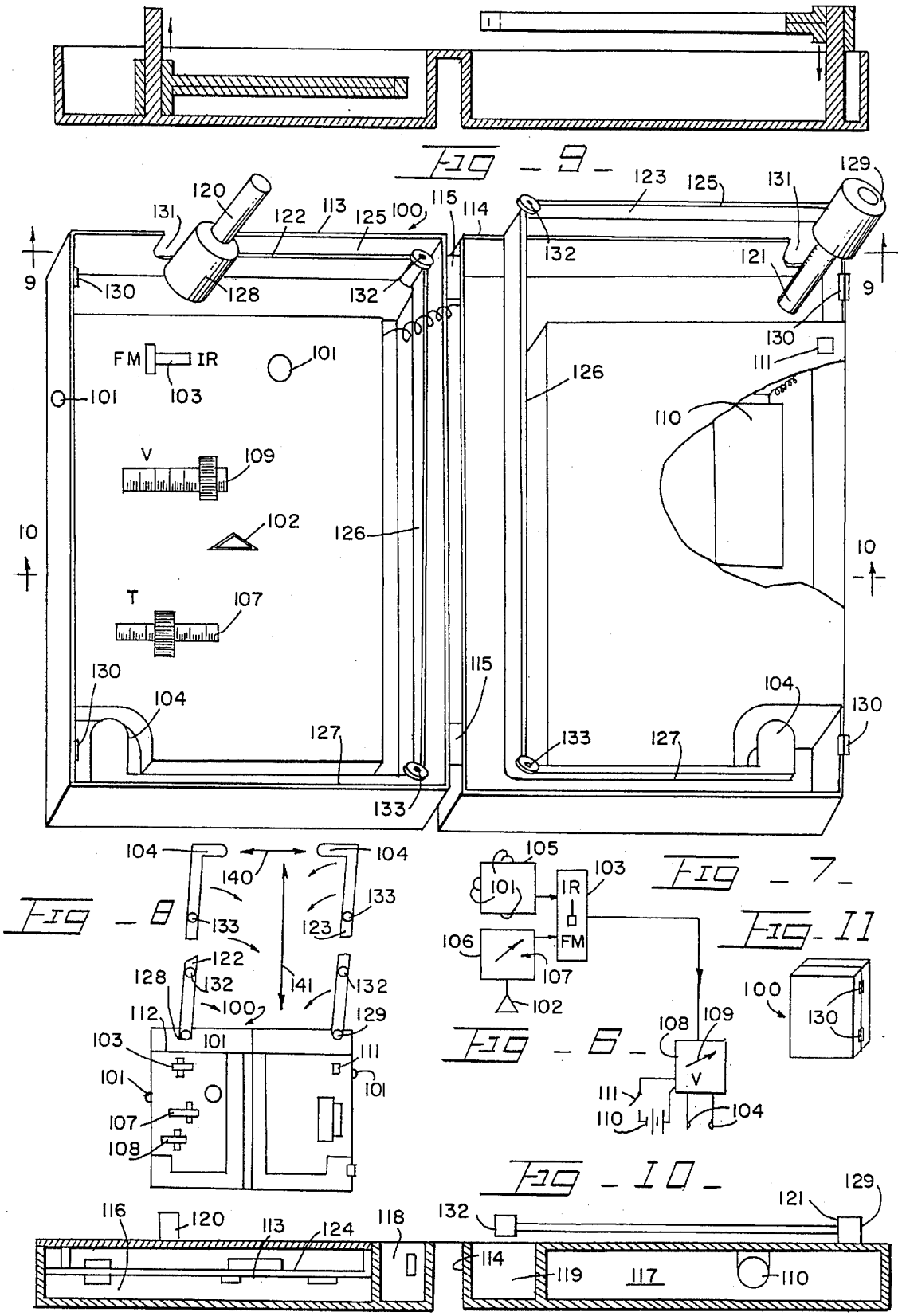
FIG. 6 is a schematic diagram of another embodiment of the invention capable of both IR and FM reception.
FIG. 7 is a perspective view of another embodiment of the invention with IR and FM and integral carrying case.
FIG. 8 is a plan view of the device of FIG. 7 open for use.
FIG. 9 is a sectional view taken through line 9—9 of FIG. 7.
FIG. 10 is a sectional view taken through line 10—10 of FIG. 7.
FIG. 11 is a perspective view of the device of FIG. 7 closed for transport.

This embodiment of the invention provides certain structured features which enhance its utility. As best seen in FIG. 11, when closed for transport, the ALD (100) provides its own hard outer shell, protecting the fragile contents from contamination and injury. The outer shell is integral with the housing (112) so that there is no possibility of misplacing the case. The housing (112) comprises two hard plastic compartments (113) and (114) joined by hinges (115). Each compartment comprises a closed chamber (116), (117) surrounded on three sides by a trough (118), (119). Each trough contains a jointed extension arm (122), (123) pivotally connected to the compartment in the trough by pivot pins (120), (121) attached to the bottom of the trough. Contained within chamber (116) is electronic circuit board (124) containing the electronic components. Contained within chamber (117) is battery (110) connected to on/off switch (111) which is depressed when the case is closed, thereby disconnecting the battery. Each extension arm is comprised of three sentiments, a proximal segment (125), an intermediate segment (126) and a distal segment (127) pivotally joined together, wherein the segments may be aligned along their long axes as shown in operational mode in FIG. 8, with the arm extended orthogonally from the trough. To extend orthogonally from the trough, the proximal end of each extension arm must be pulled up alone pin (120) and pin (121) until it is clear of the trough so that it may be rotated. Notches (131) in the case receive the extended arms and maintain the orthogonal position to apply tension to earpieces. To fold the arms and store them for transport, they are folded around the compartments (113), (114) so that they will fit into the troughs, and then the proximal pivot ends (128), (129) are pushed down on pins (120), (121) until the folded arms fit into the troughs. At this time the two halves may be folded together with snap catches (130) holding the case closed. The ALD when closed has dimensions no greater than a conventional spectacle case for ease of storage and transport. The hard plastic outer covering protects the contents from soiling or damage.

The intermediate pivots (132) and distal pivots (133) may be constructed as shown in FIGS. 3 and 4, with all of the three pivots of an extension arm rotating in a first common direction for extension and a second common direction for folding into the trough surrounding the compartments.

As best seen in FIG. 8, when in the extended or operational configuration, the distance (140) between opposed earphones is less than the distance between a user's ears. The extension arms (122), (123) are elastic, so that when they are spread apart to fit onto the ears, spring bias holds them in place. The pivots have stops to prevent them from excessive rotation beyond the extended position wherein the arm portions are aligned along their long axes.

The earphones (104) are extended at a distance (141) far enough from housing (112) that the housing lies below the user's chin when in operation.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A self-contained assistive listening device for converting audio information transmitted on FM radio or infrared radiation carriers into audible sound at the ears of a user, the device comprising:

A) FM radio receiver means for receiving, amplifying and decoding the FM radio radiation carrier and providing therefrom an electrical audio signal containing said audio information;

B) infrared receiver means for receiving, amplifying and decoding the infrared radiation carrier and providing therefrom an electrical audio signal containing said audio information;

C) audio amplifier means connected to the FM radio receiver means and the infrared receiver means for amplifying said audio signal received from either the FM radio receiver means or the infrared receiver means;

D) volume control means connected to said amplifier means for adjusting the strength of the amplified audio signal from said amplifier means;

E) electric power means connected to the amplifier means and the two receiver means for providing electric power to said device;

F) a housing having broad front and back faces with the peripheries thereof joined together by a narrow perimetral edge to define an enclosure, said enclosure containing the FM radio receiver means, the infrared receiver means, the amplifier means, said volume control means, and said electric power means;

G) a pair of elongate arms, each arm of said pair of elongate arms connected at a proximal end to said housing, said each arm having a long axis;

H) an earphone attached at a distal end of said each arm and operatively connected to the amplifier means for converting the amplified audio signal into audible sound at the ears of the user; and I) said perimetral edge being substantially rectangular, comprising a top edge portion, a bottom edge portion and two side edge portions, and said arm being pivotally connected at a proximal end to the perimetral edge by a proximal pivot, each arm comprising an elongate first arm portion and an elongate second arm portion joined together by a second pivot, with said each arm portion having a long axis;

said each arm arranged to fold up adjacent the narrow edge portions of said housing in a compact storage or folded configuration in which the first arm portion lies substantially parallel to said top edge portion and the second arm portion lies transverse to the first arm portion, substantially parallel to one of the two side edge portions with the earphone protectively adjacent said housing, said each arm arranged to unfold to an extended operational configuration in which the earphones are positioned away from said housing, opposed to one another, and spaced apart from one another a distance less than the distance between the user's ears so that when the earphones are applied to the ears, spring bias generated by forcing the arms apart will hold the earphones in place in the ears, each said proximal pivot providing rotary motion of the first arm portion between the folded configuration parallel to and adjacent said top edge portion and the operational configuration lying transverse to said top edge portion and each said second pivot providing rotary motion of the second arm portion between the folded compact configuration transverse to the first arm portion and adjacent a side edge portion and the operational configuration in which the long axes of the first and second arm portions are substantially aligned, the proximal and second pivots of a given arm both rotating in a first common direction for extension and in a second, opposite, common direction for folding, and provided with stop means to prevent the arm portions rotating beyond the operational configuration so that spreading apart the earphones will generate said spring bias.

2. The device according to claim 1 further comprising switch means for selectively operatively connecting either the FM radio receiver means or the infrared receiver means to the earphones.

3. The device according to claim 1, further comprising on/off switch means connected to said electric power means for automatically disconnecting the electric power when in said folded configuration.

4. The device according to claim 1, wherein said each arm further comprising a third arm portion pivotally connected by a third pivot to the second arm portion at an end of the second arm portion opposite said second pivot, the third arm portion arranged to lie transverse to the second arm portion when folded and substantially aligned with said second arm portion when extended in the operational configuration.

5. The device according to claim 4, further comprising rigid trough means integral with said housing, said trough means arranged to receive therein the arms when in the folded configuration.

6. The device according to claim 4, in which the third pivot is provided with a second stop means to prevent the third arm portion from rotating beyond the operational configuration so that spreading apart the earphones will generate said spring bias.

7. The device according to claim 6, further comprising trough means integral with said housing, said trough means arranged to receive therein the arms when in folded configuration.

8. The device according to claim 1, further comprising a plurality of infrared sensors facing in different directions and connected to said infrared radiation receiver means.

* * * * *